United States Patent [19]

O'Brien et al.

[11] 4,072,158

[45] Feb. 7, 1978

[54] TENT HAVING VERANDA-STYLE EXTENSION

[75] Inventors: Thomas J. O'Brien, 4919 N. Magnolia, Chicago, Ill. 60640, David A. Parsons, Hometown, Ill., Virginia Ruth Harger, Byron, Ill.

[73] Assignee: Thomas J. O'Brien, Chicago, Ill.

[21] Appl. No.: 781,738

[22] Filed: Mar. 28, 1977

[51] Int. Cl.[2] ..... A45F 1/00

[52] U.S. Cl. ..... 135/1 R; 135/DIG. 7

[58] Field of Search ..... 135/1 R, DIG. 7, 14 D, 135/14 V

[56] References Cited

U.S. PATENT DOCUMENTS

| | | | |
|---|---|---|---|
| 1,533,820 | 4/1925 | Whitehead | 135/DIG. 7 |
| 1,927,387 | 9/1933 | Bixenstein | 135/1 R |
| 2,345,377 | 3/1944 | Bowen | 135/1 R |
| 3,004,592 | 10/1961 | Norton | 135/1 R |
| 3,800,814 | 4/1974 | Hibbert | 135/1 R |
| 3,943,952 | 3/1976 | Marquart et al. | 135/1 R |

*Primary Examiner*—Werner H. Schroeder
*Assistant Examiner*—Conrad L. Berman
*Attorney, Agent, or Firm*—McCaleb, Lucas & Brugman

[57] ABSTRACT

Novel portable shelter apparatus including a side portion which can be detached along three of its four sides and raised to a substantially horizontal position, an extendable floor portion that can be unrolled from its normal storage position to an extended floor position underneath the raised side portion, and side wall netting operable to interconnect the raised side and extended floor portions to provide, within an insect-proof environment, a substantially increased floor space and increased user visibility.

5 Claims, 8 Drawing Figures

TENT HAVING VERANDA-STYLE EXTENSION

BACKGROUND OF THE INVENTION

1. Field of the Invention

This invention relates to tents and portable shelters and more particularly to tents having expandable work and living areas.

2. Description of the Prior Art

Due to the ever-increasing interest in camping and to the need for shelter structures that provide comfort as well as protection from the elements, the need has arisen for a tent structure which, at the option of the user, can be readily expanded to provide increased, yet fully protected, living and working areas.

Many existing tents and other type portable shelters do provide or can be modified to provide increased working areas by utilizing tarps, shelter flaps, or rain panels that can be attached — permanently or temporarily — adjacent the side or end wall openings of the main tent structure. Additionally, some tents have side or end walls that can be stretched out, or sometimes rolled up out of the way, to provide free access between the tent's interior and exterior areas. (A prior art tent typifying the foregoing is illustrated by U.S. Pat. No. 3,800,814.) While most modifications to existing tent structures do result in additional flexibility, they also give insects and the elements free access to the tent's interior areas. And for those few designs which do allow a side wall to be temporarily replaced by insect netting, no provision is made to increase the tent's floor space or increase the user's exterior visibility. Additionally, many tent designs offer no flexibility whatsoever.

SUMMARY OF THE INVENTION

The present invention is a portable shelter — the preferred embodiment of which is described as a tent of the basic A-frame type — which includes not only the usual floor with attached end walls and side walls held erect by the tent's frame members, but also where at least one side or end wall is capable of being unfastened along three sides and then raised and maintained at a substantially horizontal position. The invention also includes a floor extension which is then unrolled from a storage position to an extended position adjacent the tent lying directly underneath the raised side wall, and further where a side wall netting panel is permanently attached between the raised side wall and extended floor so as to interconnect the same thereby to provide an enclosed, veranda-type extension adjacent the main tent structure. When not in use, both the side wall netting and floor extension can be rolled up and stored in an out-of-the-way location adjacent the interior surface of the raisable side wall. An alternate embodiment of the present invention utilizes zipper fasteners to detachably interconnect the side wall netting panel from the floor extension so that the raised side wall can be used separately as merely a sun screen, if so desired.

Thus, the novel extendable components of the present invention are capable of providing the tent's user, at his option and at only a small increase in the tent's overall weight, with additional floor space that is enclosed and thereby protects the user from the elements, especially insects, and which further provides a substantially 180° uninhibited view to the exterior from within the tent. This portable shelter invention, then, is in contrast to prior art tent structures that either do not provide additional floor space, or if they do provide additional work areas and access adjacent the main tent structure, they do not give protection from the elements. Thus it is a principal object of this invention to provide a tent structure that can be readily expanded to give an increased living and working area that is protected from the elements.

It is a further object of this invention to provide a tent structure having an enclosed veranda extension that provides increased user visibility.

It is a still further object of the present invention to provide a tent structure that can give expanded living areas as desired yet is lightweight so as to be easily carried.

The means by which the foregoing and other objects of the present invention are accomplished and the manner of their accomplishment will be readily understood from the following specification upon reference to the accompanying drawings, in which.

DESCRIPTION OF A PREFERRED EMBODIMENT

Figure 1:
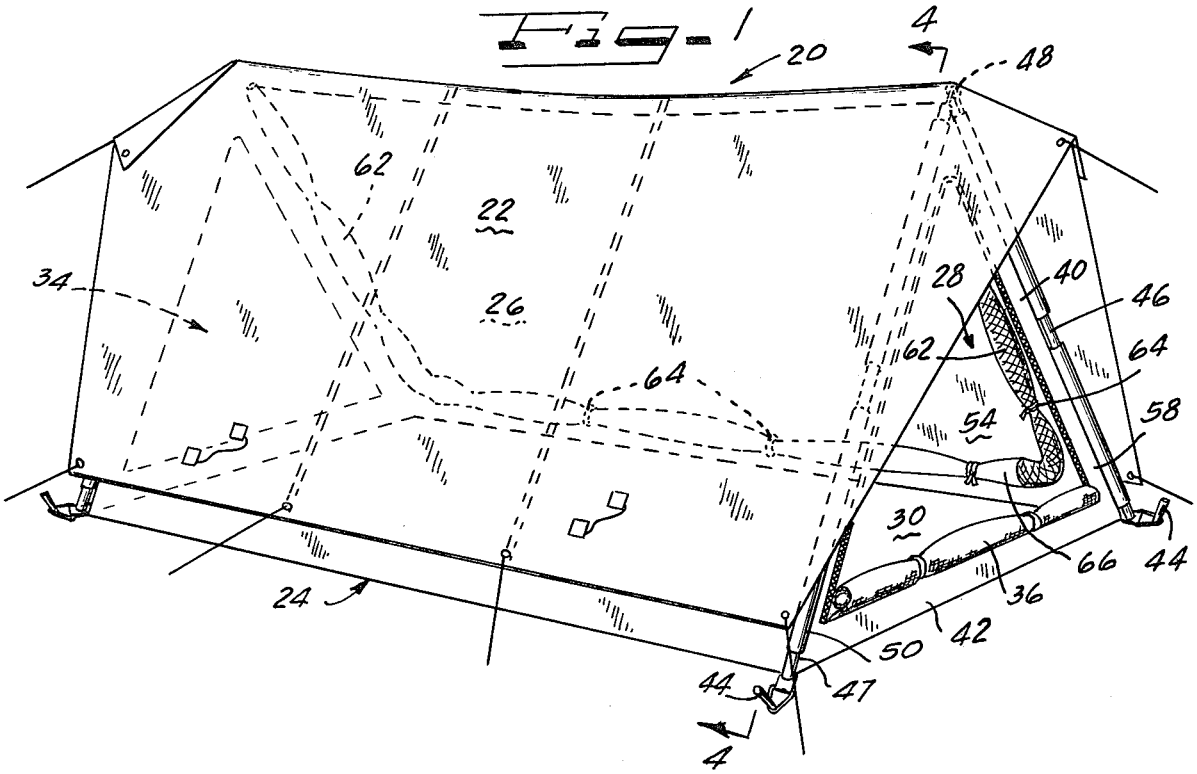
FIG. 1 is a perspective end view of the tent of the preferred embodiment of the present invention showing certain portions in their stored or unextended positions, and also depicting an associated rain fly.
Figure 2:
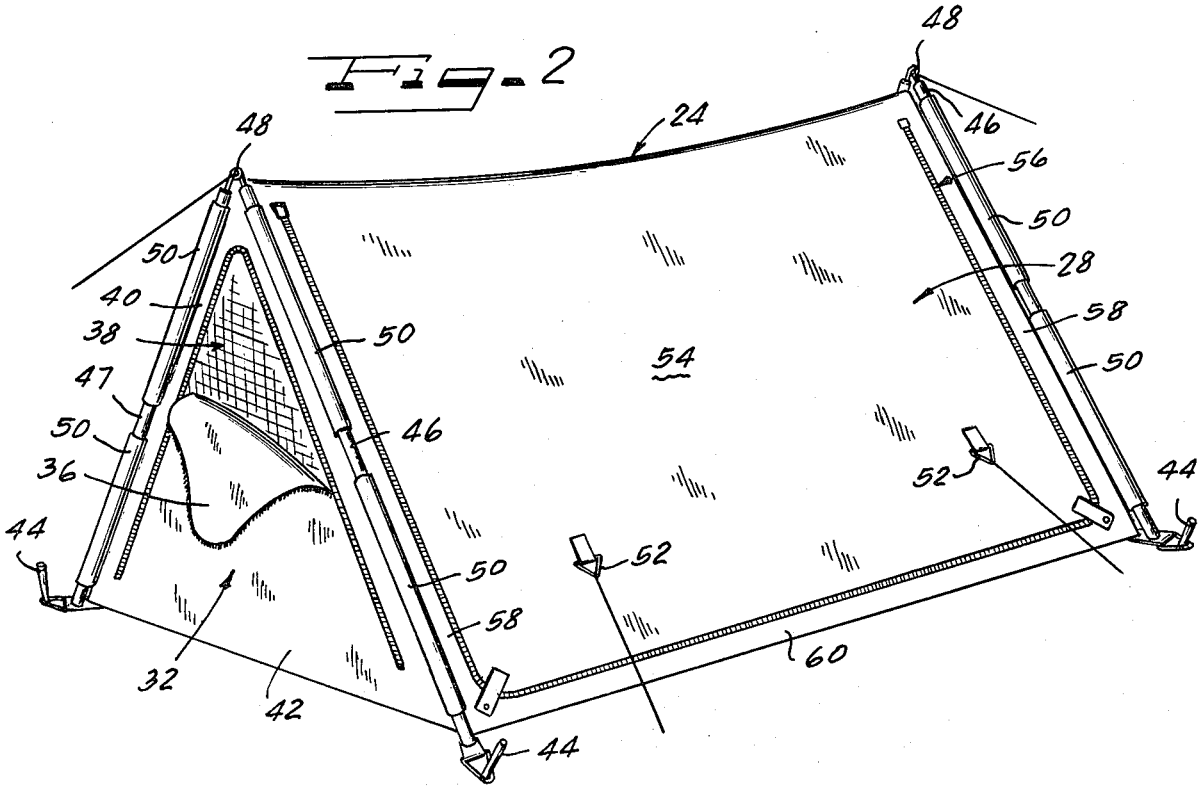
FIG. 2 is a perspective end view of the tent of FIG. 1 from the side opposite that depicted therein, without a rain fly, but showing certain tent components in their partially open positions.
Figure 4:
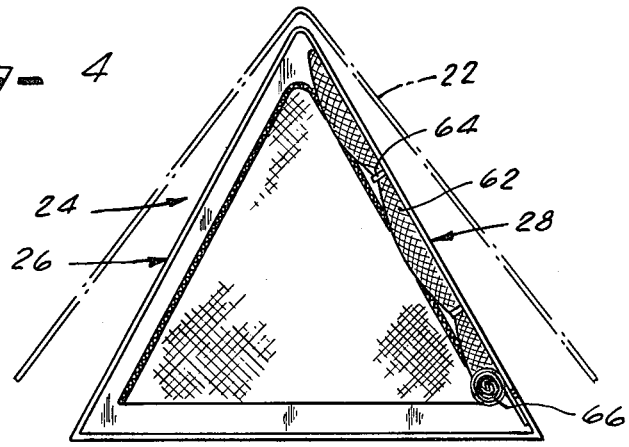
FIG. 4 is an end view of the tent shown in FIG. 1 taken along line 4—4 thereof.

Having reference to the drawings, wherein like reference numerals indicate corresponding elements, there is shown in FIG. 1 a portable shelter, generally denoted by reference numeral 20, which includes a rain fly 22 which is roped and staked-off in a well-known manner, and a tent structure 24 of the common A-frame type. As best seen in FIGS. 1, 2 & 4, a preferred embodiment of the tent structure 24 of the present invention has side walls 26, 28, a main floor member 30 and end walls 32, 34, all of which are preferably formed from waterproof fabric, for example, and which are sewn or otherwise fastened together to form a shell. The end walls 32, 34 are similar in design and only one will be described herein. End wall 32 is fashioned to include a door flap 36 and an inner mesh panel or door netting 38, both of which are detachably connected along their upstanding edges, such as by zippers, for example, to a door border member 40, the lower edge of which forms a door tub member 42. The latter functions in a well-known manner to prevent water and ground debris from entering the tent's interior.

Figure 3:
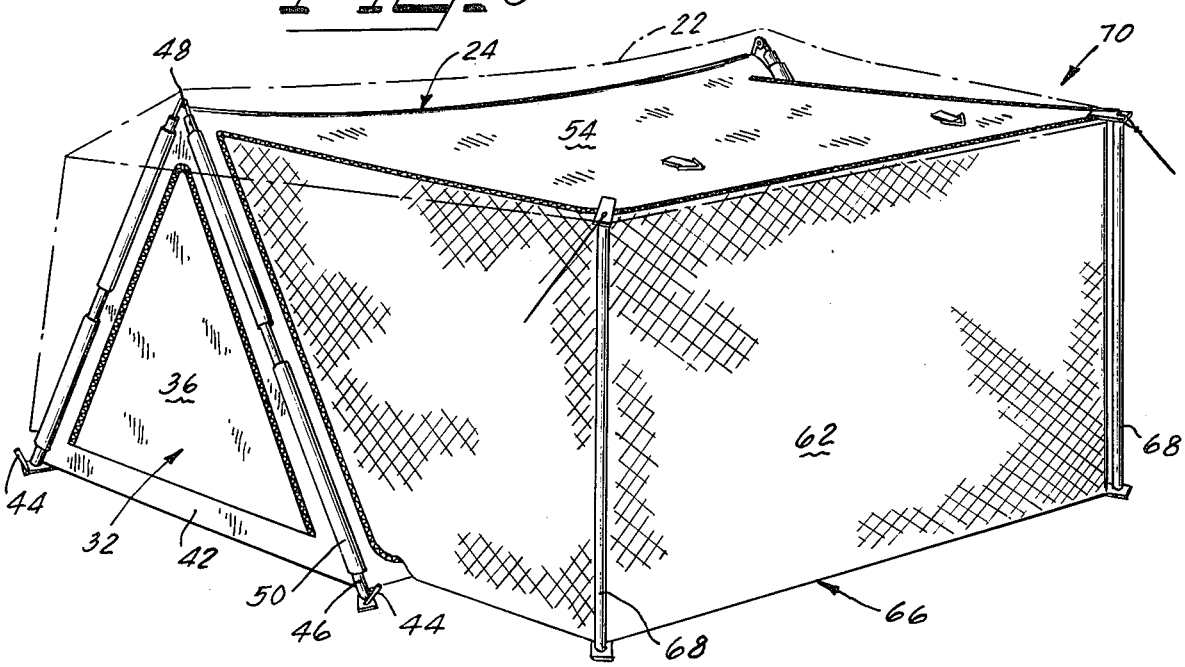
FIG. 3 is a perspective end view of the tent of FIGS. 1 & 2, but depicting the tent's extendable components in their fully extended positions, and further depicting a rain fly in phantom.

As best seen in FIGS. 1, 2, & 3 the door flap 36 and the door netting 38, can be left in their fastened positions or can be unzipped, rolled down, and tied off in a storage position adjacent tub member 42. It will be understood that, in a well known manner, the tent 24 is held erect in the A-frame shape by use of stakes 44 at the tent's four corners and by use at the tent's ends of two sets of lightweight poles 46, 47, the latter being joined adjacent the tent's ridge line by spring clips 48 and also slipped through collar members 50 formed at the corners of the tent 24. If desired, the side walls 26, 28 can be roped-off through use of common D-rings 52, so as to give increased room to the tent's interior.

Figure 7:
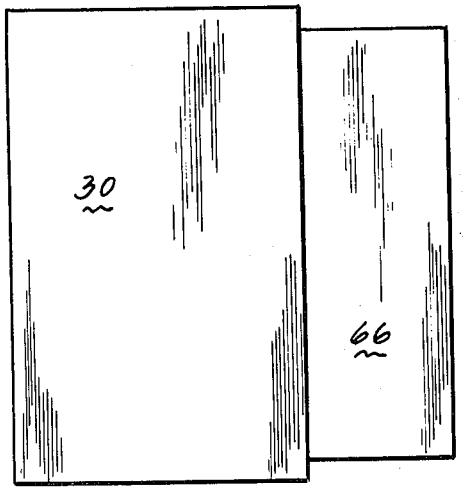
FIG. 7 is a plan view of either embodiment's main and extended floor segments.
Figure 8:
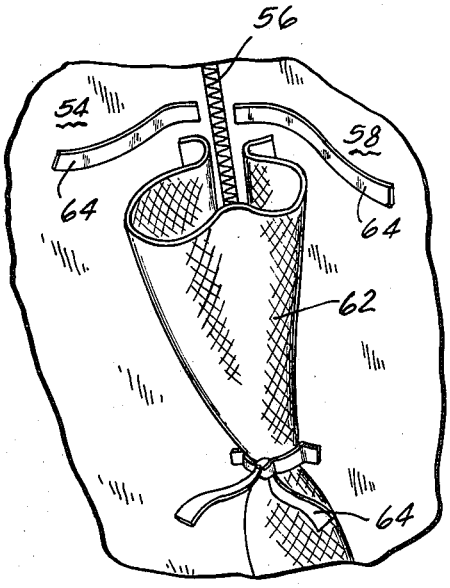
FIG. 8 is a fragmentary perspective view of an interior, vertical corner portion of the tent of FIGS. 1 & 2 when in its unextended position.

As best seen in FIG. 2, the side wall 28 is formed of a side wall extension member 54 which is detachably fastened along three of its edges, such as by a zipper indicated generally by numeral 56, to a side wall border member 58; the latter includes a side wall tub member 60 at its lower edge. As illustrated in FIGS. 1, 4, & 8, a U-shaped panel of netting 62 — similar in kind to door netting 38 — is permanently fastened adjacent the zipper 56, such as by sewing, for example, to the interior surfaces of extension member 54, the side wall border 58, and the side wall tub member 60, and is tied thereto in a rolled-up, storage fashion by several ties 64. A floor extension member 66 (FIGS. 1, 3, 4, & 7), formed preferably of a waterproof fabric similar to that of main floor member 30, is permanently attached, such as by sewing, for example, along one of its edges to the interior surface of tub 60 and along its other three edges to netting 62. As will be explained later herein, the floor extension 66 can be extended to the exterior of tent 24. A pair of appropriately roped-off auxiliary poles 68, 68 are used to support the side wall extension 54 and netting 62 in their raised and extended positions (FIG. 3).

Turning now to the operation of the novel extendable features of the preferred embodiment of the present tent invention, it will be understood that the side wall extension 54, side wall netting 62, and floor extension 66 can be maintained in their rolled-up storage positions (FIGS. 1 & 4) allowing the tent 24 to be used in its normal A-frame configuration. The latter, of course, only allows use of the floor space given by main floor 30. However, if additional interior living and working space in the tent 24 is desired, the novel extension components of the present invention can be employed to result in the additional floor space of extension floor 66 (FIG. 7). As depicted in FIG. 3, the zipper 56 is unfastened allowing the side wall extension 54 to separate from border member 58 along the former's two vertical and lower horizontal edges and to be raised up and maintained in a substantially horizontal position by auxiliary poles 68. Additionally, the combination roll of the netting 62 and floor extension 66 (FIGS. 1 & 4) can be untied and unrolled and placed in their fully extended positions so as to result in a veranda-type, insect proof structure 70 extending to the side of tent 24 (FIG. 3).

It is thus seen that use of the extendable components of the present invention provide additional living and work space to a portable shelter in the form of a veranda-type extension 70 which is protected from the elements and, because of associated netting material, allows an uninhibited 180° view from inside the tent to the exterior.

Figure 5:
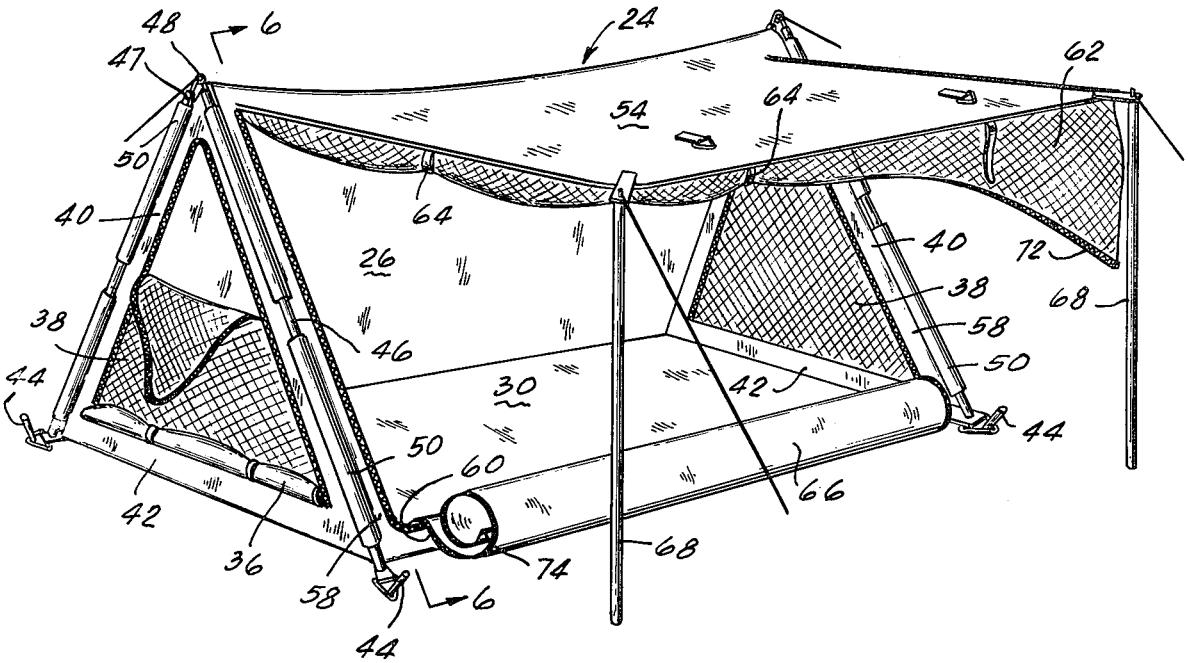
FIG. 5 is a perspective end view of an alternate embodiment of the tent of the present invention, and depicting various components shown in their partially extended and raised positions.
Figure 6:
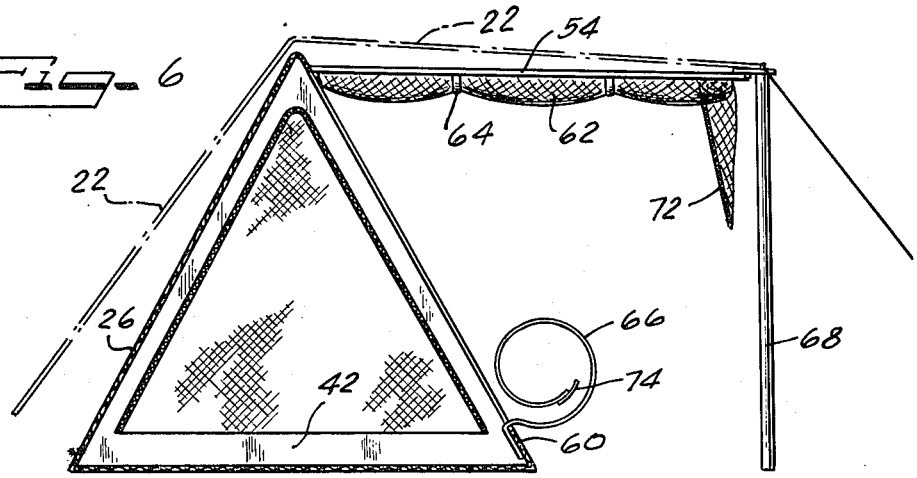
FIG. 6 is an end view of the tent of the alternate embodiment of the present invention taken along line 6—6 in FIG. 5, and further depicting an associated rain fly in phantom.

Turning to an alternate embodiment of the present invention (see FIGS. 5 & 6), it will be understood that, while the side wall netting 62 of the preferred embodiment of the present invention is depicted in the drawings as permanently attached to not only the side wall extension 54, but also to the floor extension 66 and the side wall border member 58 (see FIG. 8), the netting 62 can alternatively be detachably fastened to the floor extension 66 and the border member 58, if so desired. This detachable condition of netting 62 — from extension 66 and member 58 — allows use of the wall extension 54 as simply a sun screen (FIGS. 5 & 6). Then when desired, the netting 62 can be untied and dropped from raised side wall extension 54 and fastened, through use of border zippers 72 and 74 respectively carried on netting 62 and floor extension 66, to the latter to again result in veranda extension 70.

It will be further understood (see FIGS. 1, 3, 4, & 6) that the associated rain fly 22 can be used regardless if the tent 24 is in the unextended or extended positions so that the former can continuously render its well-known benefits, such as providing rain and sun protection to the tent and creating an air space which allows the tent's side walls to breathe.

From the foregoing, it is believed that those skilled in the art will readily appreciate the unique features and advantages of the present invention over previous types of portable shelter apparatus. Further, it is to be understood that while the present invention has been described in relation to a particular preferred and an alternate embodiment as set forth in the accompanying drawings and as above described, the same nevertheless is susceptible to change, variation and substitution of equivalents without departure from the spirit and scope of this invention. It is therefore intended that the present invention be unrestricted by the foregoing description and drawings, except as may appear in the following appended claims.

The embodiments of the invention in which an exclusive property or privilege is claimed are defined as follows:

1. In a portable shelter apparatus of the type including interconnected end walls, a floor and side walls and where at least one of the side or end walls can be elevated to a substantially horizontal position, the improvement comprising: a veranda extension comprising an extendable floor portion connected adjacent the shelter's floor along one edge portion thereof, operable to be unrolled from a storage position to a fully extended position exteriorly of the shelter; and a side wall portion characterized as being respectively attached along the exterior perimeters of said extendable floor portion, an elevated wall of the portable shelter, and the adjacent walls of the shelter, whereby said extendable floor and side wall portion cooperate with said elevated side wall to provide the portable shelter with an insect-proof living area of increased size.

2. The invention of claim 1, wherein said side wall portion comprises netting material thereby to promote ventilation of said veranda extension.

3. An expandable tent structure comprising a rigid framework; an outer fabric shell supported by said framework so as to form an erect tent enclosure; said shell comprising interconnected side walls, end walls, and a main floor portion, at least one of said side walls characterized as being detachable substantially along its three edges which lie adjacent said end walls and main floor portion; said detachable side wall capable of being raised and maintained in a substantially horizontal position; an extendable floor portion connected to said shell along the edge of said main floor that lies adjacent said detachable side wall; and side wall netting capable of being attached respectively to the exterior edges of said extended floor portion and said raised side wall, and further attached to said fabric shell as appropriate thereby to provide an enclosed veranda extension thereto which has increased living area.

4. In a tent formed of a flexible, fabric-like shell including interconnected side and end walls secured at their lower edges to a floor member to define a roofed tent enclosure therewithin, a veranda extension therefor comprising: at least one wall of the tent capable of being detached from the shell along its lower horizontal and vertical side edges and elevated and maintained at a substantially horizontal position; an extendable floor portion attached to the tent's shell along the edge of the floor member that lies adjacent said detachable wall, said extendable floor further characterized as being capable of being rolled out from a storage position to a fully extended position beneath said elevated wall; and a mesh panel member attached along its respective horizontal edges to the respective exterior edge portions of said elevated wall and extendable floor portion, and further connected along its vertical edges to said flexible tent shell, whereby said veranda extension, once erected, provides the tent with increased, insect-proof living area and increased user visability.

5. The invention of claim 4, wherein said detachable wall is a side wall.

* * * * *